US007959394B2

(12) United States Patent
Abegglen et al.

(10) Patent No.: US 7,959,394 B2
(45) Date of Patent: Jun. 14, 2011

(54) GLUE APPLICATOR FOR APPLYING AN ADHESIVE TO THE SPINE OR ADJACENT AREAS OF A BOOK BLOCK BEING CONDUCTED PAST THE GLUE APPLICATOR IN A TRANSPORT DIRECTION

(75) Inventors: Christian Abegglen, Frauenfeld (CH); Peter Fischer, Winterthur (CH)

(73) Assignee: Müller Martini Holding AG, Hergilswil (CH)

( * ) Notice: Subject to any disclaimer, the term of this patent is extended or adjusted under 35 U.S.C. 154(b) by 918 days.

(21) Appl. No.: 11/823,718

(22) Filed: Jun. 28, 2007

(65) Prior Publication Data

US 2008/0003080 A1 Jan. 3, 2008

(30) Foreign Application Priority Data

Jun. 30, 2006 (EP) ..... 06405282

(51) Int. Cl.
*B42C 9/00* (2006.01)
*B42C 13/00* (2006.01)
*B42C 5/00* (2006.01)

(52) U.S. Cl. ..... 412/37; 412/9; 412/11; 412/14; 412/33; 412/900; 412/901

(58) Field of Classification Search ..... 412/9, 11, 412/14, 33, 37, 900, 901
See application file for complete search history.

(56) References Cited

U.S. PATENT DOCUMENTS 5,716,182 A * 2/1998 Leu ..... 412/37

FOREIGN PATENT DOCUMENTS

| | | |
|---|---|---|
| DE | 1 002 729 | 2/1957 |
| DE | 26 35 108 | 2/1977 |
| DE | 30 26 446 | 3/1981 |
| DE | 102 42 259 | 3/2004 |
| DE | 102 42 260 | 3/2004 |
| EP | 0 769 368 | 4/1997 |
| EP | 1 084 864 | 3/2001 |
| EP | 1 208 998 | 5/2002 |

OTHER PUBLICATIONS

Liebau/Heinze, Chapter 4.2.3.3.6, Industrielle Buchbinderei, 2001.

* cited by examiner

*Primary Examiner* — Dana Ross
*Assistant Examiner* — Justin V Lewis
(74) *Attorney, Agent, or Firm* — Lucas & Mercanti, LLP; Klaus P. Stoffel

(57) ABSTRACT

A glue applicator for applying an adhesive to the spine of a book block or to adjacent areas of a book block of stacked printed sheets being conducted past the glue applicator includes a tank holding liquid adhesive, into which at least one glue applicator roll dips to take up the adhesive and to transfer it to the spine of the book block, the roll being driven in the same travel direction as the book block, wherein the glue applicator roll works together with a doctor blade which is installed above the surface of the glue in the tank, and wherein the doctor blade determines the thickness of the adhesive film to be transferred to the spine of the book block through variation of its distance from the glue applicator roll, and where an actuating element for the doctor blade is positively connected to a cam disk, which is driven by a motor.

8 Claims, 5 Drawing Sheets

GLUE APPLICATOR FOR APPLYING AN ADHESIVE TO THE SPINE OR ADJACENT AREAS OF A BOOK BLOCK BEING CONDUCTED PAST THE GLUE APPLICATOR IN A TRANSPORT DIRECTION

BACKGROUND OF THE APPLICATION

1. Field of the Invention

The present invention relates to a glue applicator for applying an adhesive to the spine or adjacent areas of a book block of stacked printed sheets being conducted past the glue applicator in a transport direction, the glue applicator consisting of a tank holding liquid adhesive, into which at least one glue applicator roll dips to take up the adhesive and to transfer it to the spine of the book block, the roll being driven in the same travel direction as the book block, where the glue applicator roll works together with a doctor blade, which is installed above the surface of the glue in the tank, and where the doctor blade determines the thickness of the adhesive film to be transferred to the spine of the book block through variation of its distance from the glue applicator roll and for adjustment purposes is connected to an actuating element driven by a motorized shaft.

2. Description of the Related Art

In the production of brochures, catalogs, paperbacks, books, and book blocks by gluing, glue applicators which apply the adhesive to the spine of the book block by means of glue applicator rolls are used in most cases. For this purpose, the loose printed sheets or pages are first stacked in a stacking device. Then the spine area is processed by milling tools, or the sheets are stitched together at the spine. Finally, through the use of an adhesive, the stacked sheets are bonded to each other and to a cover or folded strip. While the spine is being processed, the glue is being applied, and the block is being assembled with the cover or folded strip, the sheets are held clamped along the sides in a transport device in such a way that that spine and the area near the spine are left free. The blocks are then conducted past stationary processing stations. The glue is applied by means of driven glue applicator rolls, the circumferential velocity of which is more-or-less the same as the transport speed of the transport device. The glue applicator rolls dip into the adhesive kept in a tank and carry the glue toward the surface to be glued. So-called doctor blades work together with the glue applicator rolls to form a transfer gap, which determines the thickness of the glue film on the glue applicator roll. If the entire length of the book block spine is not to be glued, the doctor blades are moved up and down by means of the drive devices in a direction perpendicular to the surface of the glue applicator rolls. After the glue has been applied to the spine, the adhesive film is smoothed out by an leveling device, such as a roll driven in the direction opposite that of the transport device. A glue applicator of the type indicated above is disclosed by Liebau/Heinze in Chapter 4.2.3.3.6, Industrielle Buchbinderei, 2001.

According to a first prior art, the doctor blades are opened and closed by means of radial cams, which are rotated in synchrony with the machine cycle. This solution suffers from the disadvantage that, for geometric reasons, the radial cams cannot be designed with the necessary slope, and thus the thickness of the glue film on the applicator rolls does not change quickly enough. The length of the glue film and its thickness must therefore be adjusted either by hand or by means of a complicated mechanism, which is driven by servo motors. As a result, the inertia of the system, which is already high to begin with, is increased even more, and the maximum achievable production speed is limited accordingly.

Another prior art is disclosed in EP 1 208 998 of the present applicant. The doctor blades are driven here by means of very directly connected, controllable electric motors. These drives can be easily operated and controlled by the machine control system. Direct interventions by the operator are not necessary. The disadvantage is that, to achieve the necessary resolution, the motor must travel a long distance, which results in a limitation on the maximum achievable production speed.

According to yet another prior art, it is proposed in DE 102 42 259 that the blades be driven by piezeoceramic actuators. Because of the relatively small achievable stroke of these piezeoceramic devices, a large ratio must be set between the travel of the drive and the travel of the blade, which leads to high mechanical load on the piezoelectric crystal. The maximum possible switching speed is thus severely limited by the mechanical strength of the piezoelectric crystal.

Another prior art, disclosed in DE 102 42 260, proposes the use of contraction hoses, controlled by compressed air, as actuators for the drive of the blades. It is known that, because of the compressibility of compressed air, delays occur between the switching-on of the compressed air and the reaction of the drive, the negative effects of which increase as the speed of the machine increases. Thus the maximum possible production speed is again severely limited.

The precision with which the application of the glue to the spine starts and ends depends directly on the form of the glue film present on the glue applicator rolls. Ideally, the boundaries of the glue film at the beginning and end should be surfaces which are perpendicular to the roll. This is not possible for various physical reasons. The glue film will therefore always have slopes of greater or lesser steepness at the beginning and end, the steepness of these slopes being determined by the ratio between the velocity of the blade perpendicular to the glue applicator roll and the circumferential velocity of the glue applicator roll. Because the circumferential velocity of the glue applicator rolls is determined by the spacing between books and the production speed, the necessary steepness and accuracy of the slopes can be achieved only by blades which are able to move at appropriately high speeds.

SUMMARY OF THE INVENTION

Therefore, it is the object of the present invention to significantly increase the speed of the blade drive in a glue applicator with glue applicator rolls in comparison with the known devices while preserving the feature that the system can be operated exclusively by the control system. In addition, measures are to be provided so that the glue applicator and the drive of the blades can be easily engaged and disengaged from each other.

The object is met according to the invention in that the actuating element is positively connected to a radial cam, which is connected to and driven by a motor.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE INVENTION

Figure 1:
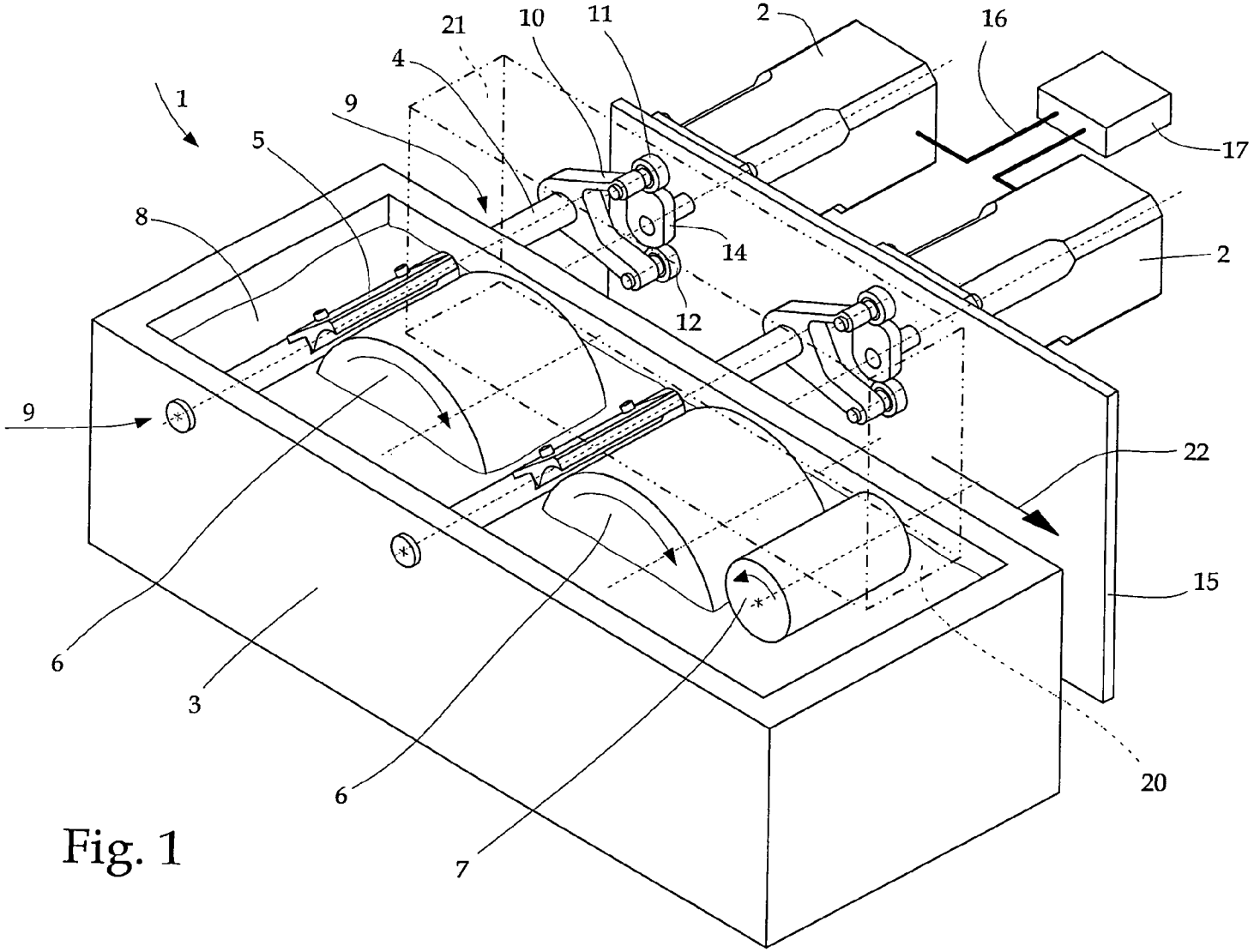
FIG. 1 is a simplified 3D diagram of a glue applicator in the working position.
Figure 2:
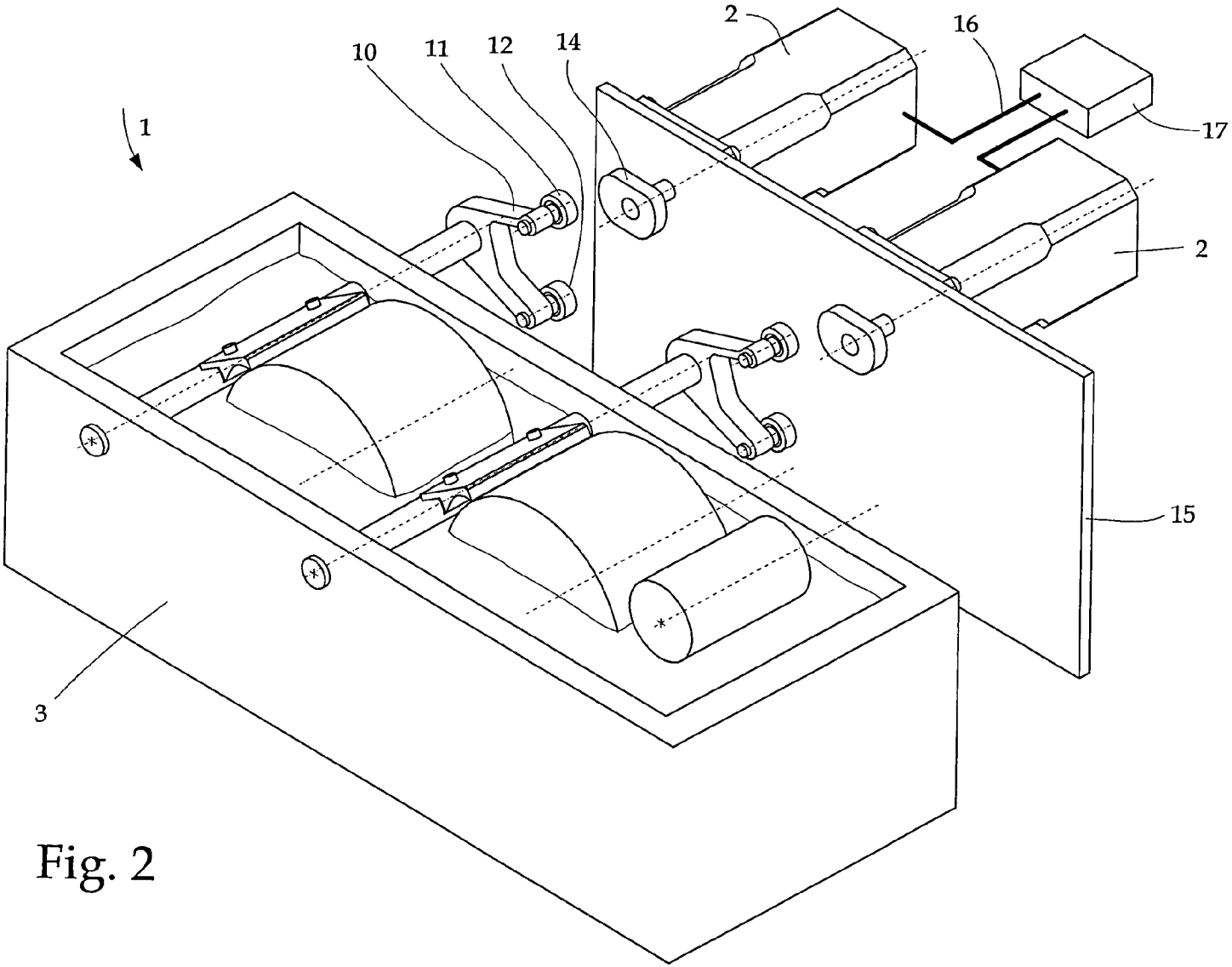
FIG. 2 is the glue applicator of FIG. 1 in the disconnected position.
Figure 3A:
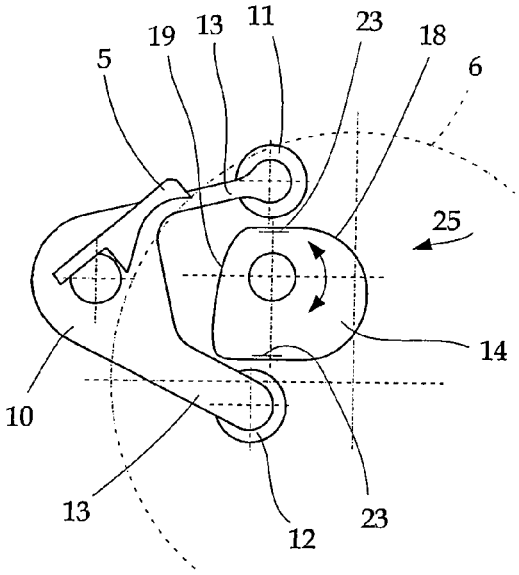
FIGS. 3*a*-3*d* are detailed views of a doctor blade drive at various angles of rotation.
Figure 3B:
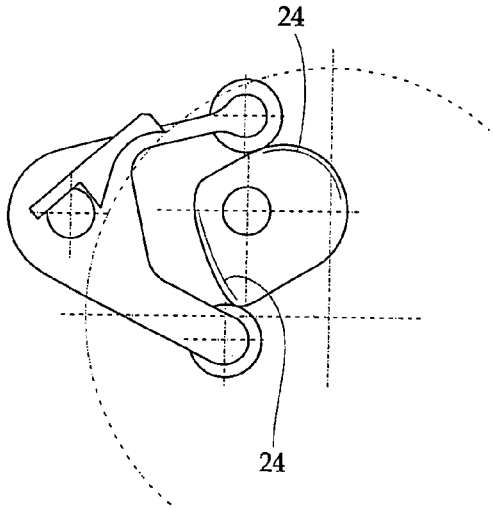
Figure 3C:
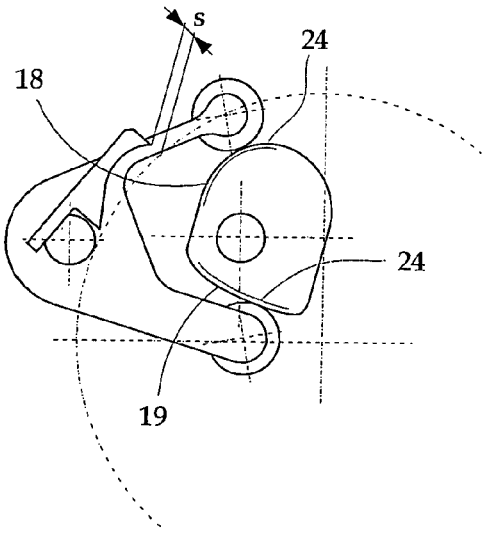
Figure 3D:
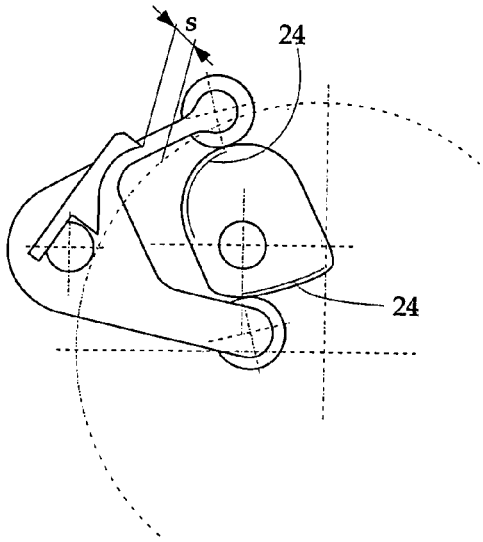
Figure 4A:
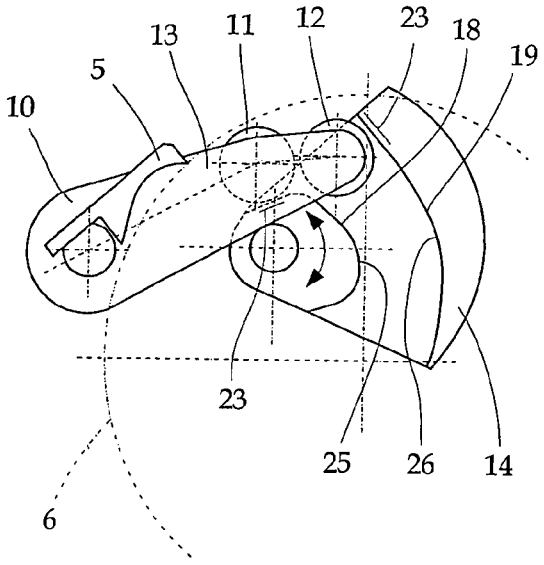
FIGS. 4*a*-4*d* are detailed views of a variant of a doctor blade drive at various angles of rotation.
Figure 4B:
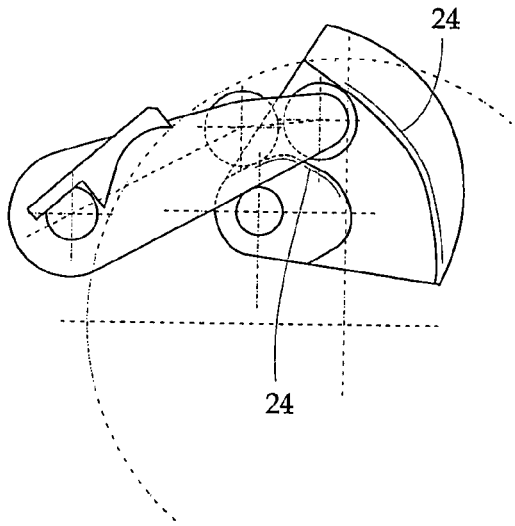
Figure 4C:
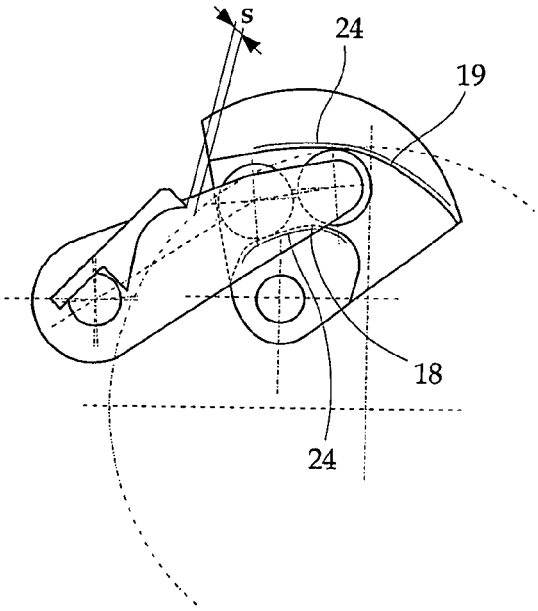
Figure 4D:
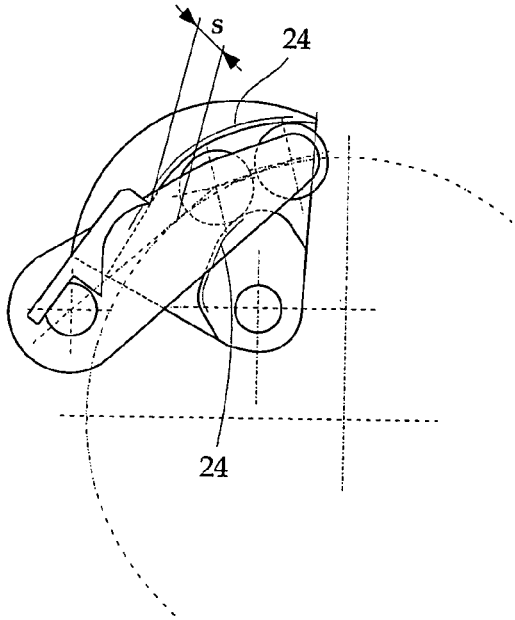
Figure 5A:
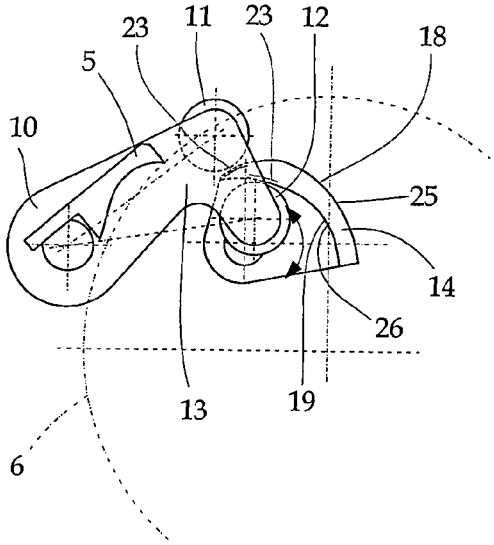
FIGS. 5*a*-5*d* are detailed views of yet another variant of a doctor blade drive at various angles of rotation.
Figure 5B:
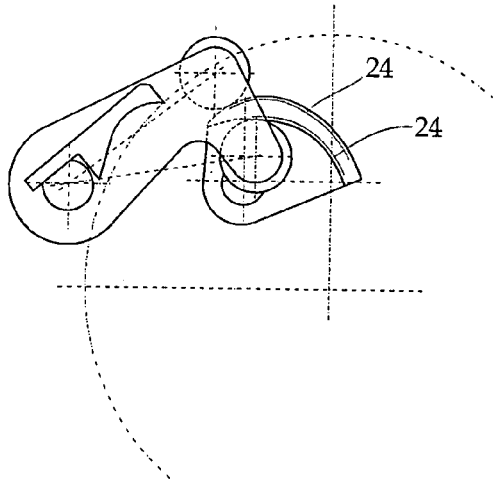
Figure 5C:
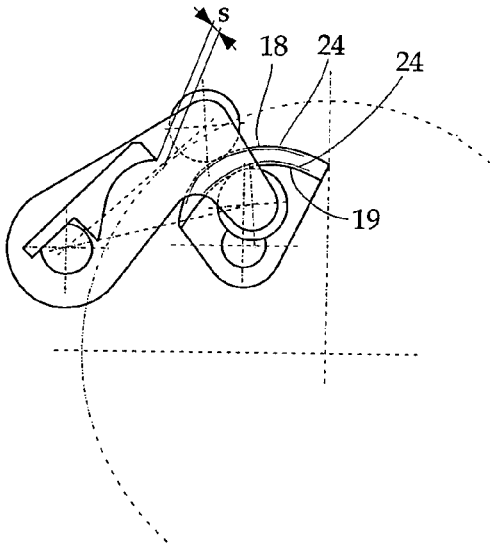
Figure 5D:
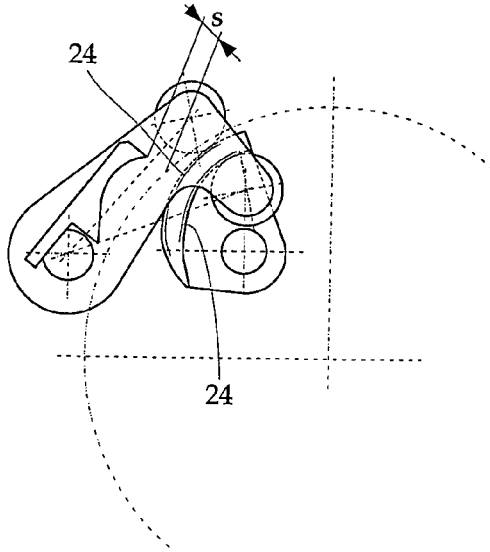

FIG. 1 shows a glue applicator 1 of an adhesive binder for gluing the spines 20 of book blocks 21. For the sake of clarity, the book block 21 is transparent, and its edges are shown in dash-dot line. The glue applicator 1 consists essentially of a tank 3 containing the adhesive 8 and glue applicator rolls 6 rotatably supported in the tank, the rolls being immersed in the adhesive 8. The glue applicator rolls 6 are driven by a drive (not shown) and rotate in the same direction as the book block 21, which is being conducted past them in the transport direction 22. The adhesive 8 adhering to the surface of the glue applicator rolls 6 is formed into a homogeneous glue film by doctor blades 5 in correspondence with the distance "s" between the blades 5 and the glue applicator rolls 6, where the thickness of the glue film corresponds to the distance "s". Areas at the beginning and end of the book block 21 should remain free of adhesive 8. This is achieved by moving the doctor blade 5 toward the glue applicator roll 6, as a result of which the distance "s" is reduced. In these areas, it is no longer possible for there to be any contact between the surface of the glue film and the book block spine 20, and the transfer of adhesive 8 to the book block spine 20 is avoided. After the glue has been applied, a roll 7, a so-called "spinner", which is driven in the direction opposite the transport direction 22, smoothes out the glue film on the spine 20, carries away excess glue 8, and returns it to the tank 3. The doctor blades 5 are attached to shafts 4, which are supported pivotably in the bearings 9 in the tank 3. The doctor blades 5 are adjusted by actuating elements 10 mounted on the shafts 4. These actuating elements are driven positively by cam disk 14. The cam disks 14 are driven by motors 2 and are mounted permanently in the machine stand 15. It is advantageous for the actuating element 10 to have two rotatably supported guide rolls 11, 12, the first guide roll 11 resting on the radial 18, the second guide roll resting on the radial cam 19, which acts in a manner complementary to the radial cam 18. Depending on the variant of the cam disk 14, the actuating element 10 is designed with one or two levers 13. It can be advisable to use different glue applicators 1 to process different adhesives 8. The glue applicators 1 can be moved into and out of the machine as complete units in the direction of the axes of the glue applicator rolls 6. The doctor blade drives are disconnected preferably at the point where the guide rolls 11, 12 meet the radial cams 18, 19. For this purpose, the radial cams 18, 19 have feed sections 23, which, when the glue applicator 1 is moved into the machine, prevents contact between the guide rolls 11, 12 and the radial cams. The cam disk 14 must be at the appropriate angle during this operation, and the blades must be closed, i.e., the distance "s" is 0. This situation is illustrated in FIG. 3*a*, FIG. 4*a*, and FIG. 5*a*. Then the cam disks 14 are rotated—in the exemplary embodiment shown here, in the counterclockwise direction—in such a way that the beginnings of the working sections 24 are facing the guide rolls 11, 12. The guide rolls 11, 12 are thus now in contact with the radial cams 18, 19, and the distance "s" between the blades 5 and the glue applicator rolls 6 is still 0. This situation is shown in FIG. 3*b*, FIG. 4*b*, and FIG. 5*b*. This angular position of the cam disks 14 corresponds to the beginning of the working stroke. In FIG. 3*d*, FIG. 4*d*, and FIG. 5*d*, the cam disks 14 are shown in the end position, and the distance "s" has reached its maximum. By rotating the cam disks 14 within the working sections 24, it is therefore possible to adjust the distance "s", where each angular position of the cam disks 14 corresponds to an associated distance "s" between the doctor blades and the glue applicator rolls. This situation is shown in FIG. 3*c*, FIG. 4*c*, and FIG. 5*c*. The cam disks 14 are driven by controlled motors 2. The angular positions and rpm's of the cam disks 14 to be achieved are calculated by a control device 17 connected to the motors 2, and the motors are controlled accordingly via the lines 16.

The design of the cam disk 14 with the essential features of the claims allows several variants.

The variant cam disk 14 in FIGS. 3*a*-3*d* has outside curves 25 for both the radial cam 18 and the complementary radial cam 19. Each of the variant cam disks 14 according to FIGS. 4*a*-4*d* and FIGS. 5*a*-5*d* has an outside curve 25 and an inside curve 26. Another variant cam disk 14 (not shown) has two inside curves 26. It is also conceivable that the radial cams 18, 19 could be located on a cam drum, the axes of the shafts 4 and of the cam drums being perpendicular to each other.

While specific embodiments of the invention have been shown and described in detail to illustrate the inventive principles, it will be understood that the invention may be embodied otherwise without departing from such principles.

We claim:

1. A glue applicator for applying an adhesive to the spine of a book block or to adjacent areas of a book block of stacked printed sheets being conducted past the glue applicator, the glue applicator comprising a tank holding liquid adhesive, into which at least one glue applicator roll dips to take up the adhesive and to transfer it to the spine of the book block, the roll being driven in the same travel direction as the book block, wherein the glue applicator roll interacts with a doctor blade installed above a surface of the glue in the tank so as to determine the thickness of the adhesive film to be transferred to the spine of the book block through variation of a distance of the doctor blade from the glue applicator roll and for adjustment purposes is connected to an actuating element driven by a motorized shaft, wherein the actuating element is positively connected to a cam disk, which is driven by a motor, the actuating element having a first guide roll and a second guide roll, wherein the first guide roll rests against a first radial cam of the cam disk and the second guide roll rests against a second radial cam of the cam disk having a complementary action.

2. The device according to claim 1, wherein the radial cams have different designs.

3. The device according to claim 1, wherein the radial cams have a feed section and a working section which follows the former section in the operating direction.

4. The device according to claim 1, wherein each of the guide rolls rests on an outside curve of the radial cam.

5. The device according to claim 1, wherein each of the guide rolls rests on an inside curve of the radial cam.

6. The device according to claim 1, wherein one of the guide rolls rests on an outside curve, while the other rests on an inside curve.

7. The device according to claim 6, wherein the actuating element is a lever mechanism.

8. The device according to claim 7, wherein the guide rolls are supported with freedom of rotation on the lever mechanism.

* * * * *